US008162470B2

(12) United States Patent
Kanai et al.

(10) Patent No.: US 8,162,470 B2
(45) Date of Patent: Apr. 24, 2012

(54) INKJET PRINTER

(75) Inventors: Hiroshi Kanai, Nagano (JP); Masaru Ohnishi, Hyogo (JP); Kenji Hashizume, Nagano (JP); Shinichi Uehara, Nagano (JP); Koji Maruyama, Nagano (JP); Katsuhisa Tsuchiya, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 0 days.

(21) Appl. No.: 12/757,042

(22) Filed: Apr. 9, 2010

(65) Prior Publication Data

US 2010/0194816 A1 Aug. 5, 2010

Related U.S. Application Data

(63) Continuation of application No. 10/510,859, filed as application No. PCT/JP03/05026 on Apr. 18, 2003, now abandoned.

(51) Int. Cl.
*B41J 2/01* (2006.01)
*B41J 29/38* (2006.01)

(52) U.S. Cl. ..... 347/102; 347/104; 347/17

(58) Field of Classification Search ..... 347/102, 347/104, 17, 29–36; 101/488; 219/216; 346/25

See application file for complete search history.

(56) References Cited

U.S. PATENT DOCUMENTS

| | | | | |
|---|---|---|---|---|
| 4,904,519 | A | | 2/1990 | Newman |
| 5,329,295 | A | | 7/1994 | Medin et al. |
| 5,406,321 | A | | 4/1995 | Schwiebert et al. |
| 5,461,408 | A | | 10/1995 | Giles et al. |
| 5,500,667 | A | | 3/1996 | Schwiebert et al. |
| 5,510,822 | A | | 4/1996 | Vincent et al. |
| 5,568,173 | A | | 10/1996 | Leenders et al. |
| 5,619,240 | A | | 4/1997 | Pong et al. |
| 5,625,398 | A | | 4/1997 | Milkovits et al. |
| 5,633,668 | A | | 5/1997 | Schwiebert et al. |
| 5,638,098 | A | | 6/1997 | Iwata et al. |
| 5,746,817 | A | * | 5/1998 | Katsen et al. ..... 106/31.65 |
| 5,751,303 | A | | 5/1998 | Erickson et al. |
| 5,761,597 | A | | 6/1998 | Smith et al. |
| 5,850,237 | A | | 12/1998 | Slade |
| 6,048,059 | A | | 4/2000 | Wafler |
| 6,132,038 | A | | 10/2000 | Szlucha |
| 6,151,040 | A | | 11/2000 | Takada et al. |
| 6,161,930 | A | | 12/2000 | Asano |
| 6,341,854 | B1 | | 1/2002 | Takemoto |
| 6,565,185 | B1 | | 5/2003 | Endo |
| 6,572,228 | B2 | | 6/2003 | Kaga et al. |
| 6,821,334 | B2 | | 11/2004 | Nakamura et al. |
| 2002/0109767 | A1 | | 8/2002 | Polierer |
| 2003/0007055 | A1 | | 1/2003 | Ogawa |

FOREIGN PATENT DOCUMENTS

DE 100-56-703 C2 11/2002

(Continued)

OTHER PUBLICATIONS

Office Action issued by the Canadian Intellectual Property office on Jan. 22, 2010.

*Primary Examiner* — Stephen Meier
*Assistant Examiner* — Leonard S Liang
(74) *Attorney, Agent, or Firm* — Ditthavong Mori & Steiner, P.C.

(57) ABSTRACT

An inkjet printer includes a printing head configured to eject solvent ink from nozzles of the printing head on a medium at a printing position. A medium is made of a polyvinyl chloride film. The solvent ink includes an organic pigment of from 3 to 7 weight %, a resin of 15 weight % or less, and solvents. A print heater is configured to heat the medium at the printing position. The print heater is arranged separately from a pre-heater. A temperature controller is configured to control a pre-heater heating temperature of the pre-heater and a print heater heating temperature of the print heater such that a surface temperature of the medium at the printing position becomes within a range of from 30° C. to 70° C.

15 Claims, 4 Drawing Sheets

FOREIGN PATENT DOCUMENTS

| | | |
|---|---|---|
| EP | 1044817 | 9/1986 |
| JP | 2000-2996607 | 10/1975 |
| JP | 58072461 | 4/1983 |
| JP | 62-144955 | 6/1987 |
| JP | 05031893 | 2/1993 |
| JP | 11-020141 | 1/1999 |
| JP | 11-129462 | 5/1999 |
| JP | 11-138848 | 5/1999 |
| JP | 2000-37942 | 2/2000 |
| JP | 2000-103043 | 4/2000 |
| JP | 2000-160089 | 6/2000 |
| JP | 2001-277543 | 10/2001 |
| JP | 2002-187293 | 7/2002 |
| JP | 2002-254794 | 9/2002 |
| JP | 2003-026962 | 1/2003 |

* cited by examiner

INKJET PRINTER

TECHNICAL FIELD

The present invention relates to an inkjet printer for printing pictorial diagrams and characters formed by arrangement of plural ink dots on a recorded medium (hereinafter, simply referred to as "medium") using ink consisting primarily of an organic solvent (hereinafter, referred to as "solvent ink"), and more specifically, to an inkjet printer capable of realizing high image quality and fixing stability of pictorial diagrams and characters printed on a medium used for outdoor display advertisement and industry that mainly require water resistance and weather resistance.

BACKGROUND ART

As shown in FIG. 4, an inkjet printer has a structure for ejecting ink droplets from nozzles 12 aligned on the lower surface of a printing head 14 and landing the ink droplets on the surface of a medium 30 mounted on a platen 20 in a dot pattern. Further, the printer has a structure for printing pictorial diagrams and characters formed by arrangement of plural ink dots on the surface of the medium 30.

In this inkjet printer, there is a drawback that, when the ink droplets are landed on the surface of the medium 30 in a dot pattern, the ink droplets permeate the medium 30 broadly in the surrounding parts of the landed points, and the pictorial diagrams and characters formed by arrangement of plural ink dots printed on the surface of the medium 30 become smeared and blurred.

As an inkjet printer that can solve such drawback, a printer as disclosed in Publication of Japanese Patent Application No. Sho-62-144955 or Publication of German Patent No. DE10056703C2 has been proposed.

In this printer, as shown in FIG. 4, a preheater 40 for heating a medium 30 before printing in advance, and an after-heater 50 for heating the medium 30 immediately after printing are provided. Droplets are prevented from permeating broadly in the surrounding parts of landed points by having preheated the medium 30 with the preheater 40 for warming it before printing so that the droplets landed on the warmed surface of the medium 30 may be dried early. Further, the droplets are prevented from permeating broadly in the surrounding parts of landed points on the medium 30 by early drying the droplets adhering to the landed points on the medium 30 immediately after printing in partly undried conditions with the after-heater 50. Thereby, the pictorial diagrams and characters formed by arrangement of plural ink dots without smearing are printed sharply and clearly on the surface of the medium 30.

By the way, in the conventional inkjet printers as disclosed in these publications, heating means (not shown) for heating the medium 30 to be carried onto a central portion 22 of the platen below the traveling path of the printing head 14, on which the ink droplets ejected from the nozzles 12 of the printing head landed, is not provided.

The reason is as follows: in the case where such heating means is provided, by the heating means, it is possible that the medium 30 to be carried onto the central portion 22 of the platen below the traveling path of the printing head 14 is heated to dry the ink droplets landed on the surface of the medium 30 early. However, simultaneously, by the heating means, the printing head 14 traveling above the central portion 22 of the platen is also heated. Then, by the influence of heat from the heating means, the ink supplied to the printing head 14 is dried, the ink is solidified within the nozzles 12 having thin diameters of the printing head, and the nozzles 12 are clogged.

By the way, the conventional inkjet printer mainly uses general-purpose water-soluble ink or lactate ink as ink supplied to the printing head 14. However, such water-soluble ink and lactate ink do not have sufficient water resistance or weather resistance. On this account, a printer using such water-soluble ink and lactate ink is not suitable for printing pictorial diagrams and characters on a medium 30 for outdoor display advertisement or the like.

On the other hand, solvent ink consisting primarily of an organic solvent has sufficient water resistance and weather resistance. Accordingly, the solvent ink as above is suitable for printing pictorial diagrams and characters on a medium 30 for outdoor display advertisement or the like. However, the solvent ink has extremely high permeability to the medium 30, and, when ink droplets thereof are landed on the surface of the medium 30, the solvent ink of the ink droplets permeate the medium 30 early and broadly in the surrounding parts of the landed points and disappear. On this account, dots of the ink can not be clearly fixed at the landed points on the surface of the medium 30, and pictorial diagrams and characters formed by arrangement of plural ink dots with no smear can not be printed on the surface of the medium 30 clearly.

Note that, as the medium 30, a medium 30 coated with various kinds of coating agents on the surface thereof for preventing the ink droplets landed on the surface from permeating the medium 30 in the surrounding parts of landed points and fixing them at the landed points to form dots having small diameters has been developed. However, the medium 30 coated with such coating agents is expensive and it can not be used as a medium 30 that is generally and widely used.

Further, as a medium 30 for outdoor display advertisement or the like, both materials such as vinyl chloride films that are easily softened by being heated at low temperature and polyester films that are not easily softened even by being heated at high temperature are used.

On the other hand, as disclosed in the above publications, in the conventional inkjet printer, the temperature at which the medium 30 is heated by the preheater 40 and the after-heater 50 is set unadjastably at constant and relatively high temperature. Accordingly, if the medium 30 carried on the platen 20 of the inkjet printer is a vinyl chloride film or the like, the medium 30 will be overheated at high temperature and softened by the preheater 40 and the after-heater 50, and thereby, the medium 30 can not be carried on the platen 20 smoothly.

The invention is objected to provide an inkjet printer capable of solving the above described problems and printing high image quality pictorial diagrams and characters formed by arrangement of plural ink dots with water resistance and weather resistance but no smear on the surface of a general-purpose medium that is not coated with a coating agent or the like using solvent ink while providing fixing stability, wherein various kinds of media such that softened at low temperature can be heated at suitable temperature and constantly carried on the platen smoothly.

DISCLOSURE OF THE INVENTION

In order to achieve the above described object, an inkjet printer of the invention has printing means for traveling a printing head above a central part of a platen in horizontal directions and carrying means for carrying a medium that has been carried onto the platen forwardly on the platen.

Further, a preheater for preliminarily heating the medium to be forwardly carried toward below the traveling path of the printing head on a rear part of the platen and a print heater for heating the medium that has been carried onto the platen, on which the inkjet droplets ejected from the nozzles of the printing head are landed, are provided.

A solvent ink is used as ink supplied to the printing head for ejecting the ink droplets. Further, heat control means for controlling heating temperature of the preheater and the print heater for heating the medium so that the surface temperature of the medium to be carried onto the central part of the platen, on which the inkjet droplets ejected from the nozzles of the printing head are landed, may be 30 to 70° C. is provided.

In the inkjet printer of the invention, by being thus arranged, the medium to be forwardly carried toward below the traveling path of the printing head on the rear part of the platen can be preliminarily heated by the preheater. Further, subsequently, the medium that has been carried onto the platen, on which the inkjet droplets ejected from the nozzles of the printing head are landed, can be heated by the print heater. Accordingly, by those preheater and print heater, the medium can be heated so that the surface temperature of the medium to be carried onto the central part of the platen, on which the inkjet droplets ejected from the nozzles of the printing head are landed, may be 30 to 70° C.

At that time, after the medium immediately before carried onto the central part of the platen is heated preliminarily by the preheater, subsequently, in order to further fully heat the medium that has been carried onto the central part of the platen by the print heater, the medium that has been carried onto the platen, on which the inkjet droplets ejected from the nozzles of the printing head are landed, can be heated constantly and reliably without excess or deficiency so that the surface temperature thereof may be temperature of 30 to 70° C.

On the surface of the medium that has been heated in an appropriate manner so that the surface temperature thereof may be desired temperature of 30 to 70° C., ink droplets of the solvent ink ejected from the nozzles of the printing head to which the solvent ink is supplied can be landed. Furthermore, the ink droplets of the solvent ink landed on the surface of the medium can be dried promptly without permeating the medium broadly in the surrounding parts of the landed points while keeping the state in which they are fixed in dots having small diameters in the landed parts on the surface of the medium that has been heated in an appropriate manner at 30 to 70° C. Thus, pictorial diagrams and characters formed by arrangement of plural solvent ink dots and having water resistance and weather resistance with no smear can be printed on the surface of the medium clearly.

Here, the reason for that the heating temperature of the medium surface is set to 30 to 70° C. is, in the case where the heating temperature of the medium surface is set to less than 30° C., the heating temperature that the ink droplets of the solvent ink landed on the medium surface receives from the medium becomes insufficient. Further, the ink droplets are not promptly dried on the medium surface, but permeate the medium broadly in the surrounding parts of the landed points. Furthermore, smear occurs in the pictorial diagrams and characters printed on the medium surface. Alternatively, in the case where the heating temperature of the medium surface is set to more than 70° C., if the medium is a vinyl chloride film having low heat resistance that is softened at temperature of 45° C. or more or the like, the degree of the softening becomes higher and the medium can not be carried on the platen smoothly. If the medium is a polyester film having high heat resistance or the like, even when the medium is heated so that the surface temperature thereof may become nearly 60° C., the medium is never disturbed to be carried on the platen. In order to enable almost all media from the medium having low heat resistance to the medium having high heat resistance to be carried on the platen without any trouble, those media is desirably heated so that the surface temperature thereof may be 70° C. or less at maximum. Further, the reason for that the medium is thus heated so that the heating temperature of the surface thereof may be 30 to 70° C. is derived from experimental results obtained by practically printing pictorial diagrams and characters on the surfaces of various media using the solvent ink.

In the inkjet printer of the invention, the temperature control means may be arranged so as to be able to independently control the heating temperature of the preheater and print heater, respectively.

In this case, each of the heating temperature of the medium carried on the rear part of the platen and heated by the preheater and the heating temperature of the medium carried onto the central part of the platen and heated by the print heater may be adjusted in an appropriate manner according to the kind and thickness of the medium and the ambient temperature at which the printer is placed. Furthermore, the temperature of the surface part of the medium carried onto the central part of the platen, on which the inkjet droplets ejected from the nozzles of the printing head are landed, can be heated constantly at desired temperature of 30 to 70° C. in an appropriate manner.

In the inkjet printer of the invention, the temperature control means may be arranged so as to be able to integrally control the heating temperature of the preheater and print heater, respectively.

In this case, since means for controlling the heating temperature of the preheater and means for controlling the heating temperature of the print heater are not provided separately, the temperature control means can be simplified.

In the inkjet printer of the invention, it is preferred that a major component of 40% by weight or more of the solvent ink to be supplied to the printing head consists of one or more of ethylene glycol monobutyl ether and propylene glycol monomethyl ether acetate.

The ethylene glycol monobutyl ether or propylene glycol monomethyl ether acetate is advantageous in the point where they are less toxic to the human body and have weak odors. Further, they are also advantageous in the point where flash points thereof are high and risks in handling are smaller.

Accordingly, if one or more of ethylene glycol monobutyl ether and propylene glycol monomethyl ether acetate is used as a major component of the solvent ink, the influence of toxicity on the human body by the solvent ink can be suppressed, the odor of the solvent ink can be suppressed, and the handling risk of the solvent ink can be suppressed.

Further, the reason for that the major component of 40% by weight or more of the solvent ink consists of one or more of ethylene glycol monobutyl ether and propylene glycol monomethyl ether acetate, is that it is confirmed that the pictorial diagrams and characters can be printed without smear but with high quality on the surface of the medium using the solvent ink while providing fixing stability from various experimental results if the major component of 40% by weight or more of the solvent ink consists as described above.

By the way, the major component of the solvent ink used for the printer of the invention is not limited to one or more of ethylene glycol monobutyl ether and propylene glycol monomethyl ether acetate, but other kinds of solvents having characters such as low toxicity to the human body, weak odors, high flash points, low handling risk, etc. can be used for the major component of the solvent ink used for the printer of the invention.

In the inkjet printer of the invention, the control of heating temperature of the preheater and the print heater for heating the medium by the heat control means may be arranged so as to be changed and adjusted by an additional operation panel to a printer or a host computer for printer control.

In this case, the heating temperature of the preheater and the print heater for heating the medium by the heat control means can be changed and adjusted by an additional operation panel to the printer or the host computer for printer control according to the kind and thickness of the medium carried on the platen or the ambient temperature at which the printer is placed. Accordingly, various kinds of media such that softened at low temperature can be constantly carried on the platen smoothly by the carrying means.

In the inkjet printer of the invention, refresh mode means for moving the printing head to a maintenance station and trial-discharging (flushing) ink droplets from the nozzles of the printing head so as to prevent the solvent ink from being solidified and causing clogging within the nozzles of the printing head may be provided.

In this case, in the process of printing pictorial diagrams and characters using the solvent ink, using the refresh mode means, the printing head can be moved to the maintenance station and ink droplets can be trial-discharged from the nozzles of the printing head. Accordingly, the solvent ink may be prevented from being solidified and causing clogging within the nozzles of the printing head. Further, missing dots (refers to the state in which no ink dot exists in positions where ink dots should exist) can be prevented from occurring in parts of pictorial diagrams and characters printed on the surface of the medium using the clogged printing head.

In addition, in the inkjet printer provided with the refresh mode means, the refresh mode means may have a structure for moving the moving the printing head to a maintenance station and trial-discharging ink droplets from the nozzles of the printing head at regular time intervals.

In this case, at regular time intervals in the process of printing pictorial diagrams and characters using the solvent ink, using the refresh mode means, the printing head can be moved to the maintenance station and ink droplets can be forced to be trial-discharged from the nozzles of the printing head. Accordingly, the solvent ink can be ensured to be prevented from being solidified within the nozzles of the printing head and causing clogging of the nozzle because of the failure to move the printing head to the maintenance station and trial-discharging ink droplets from the nozzles of the printing head in the process of printing pictorial diagrams and characters using the solvent ink.

In the inkjet printer of the invention, drying means for drying the ink droplets adhering to the landed points of the surface of the medium carried onto the front part of the platen from below the printing head may be provided.

In this case, the droplets adhering to the landed points of the surface of the medium carried onto the front part of the platen from below the traveling path of the printing head in partly undried conditions can be dried completely by the drying means. Further, the droplets adhering to the landed points of the surface of the medium in partly undried conditions, which is carried onto the front part of the platen and taken up in a roll form or the like by the take-up means at the front side of the platen can be prevented from adhering to other parts of the medium and contaminating the medium with the ink.

BEST MODE FOR CARRYING OUT THE INVENTION

Next, the invention will be described according to the drawings.

Figure 1:
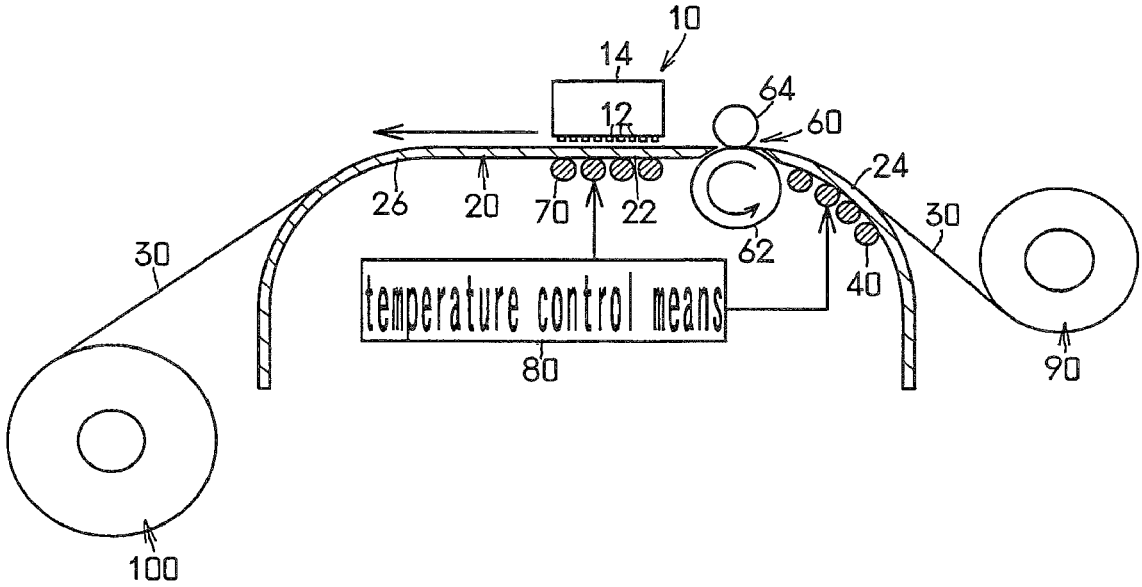
FIGS. 1 and 2 are a side sectional view and a front view showing the schematic structure of an inkjet printer of the invention.
Figure 2:
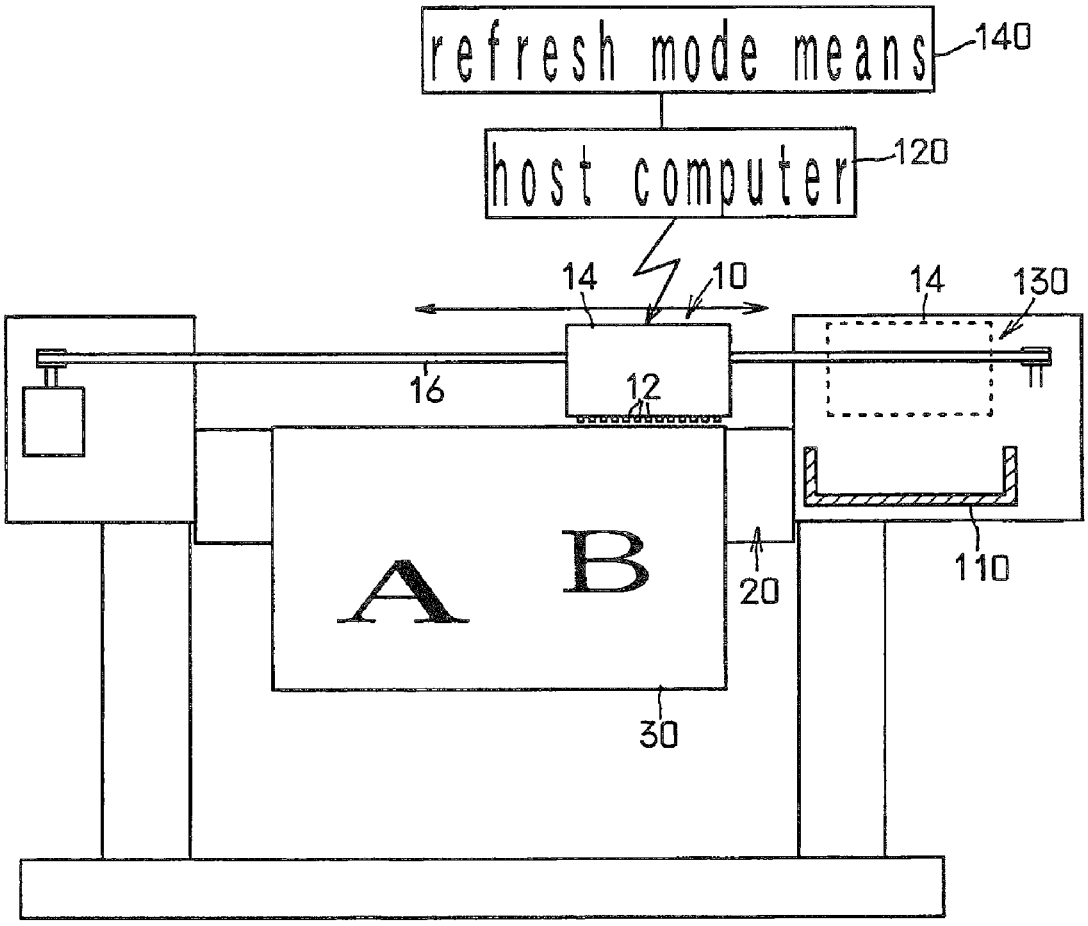

An inkjet printer shown in FIG. 1 and FIG. 2 has printing means 10 for traveling a printing head 14 above a central part 22 of a platen in horizontal directions (frontward and rearward directions in FIG. 1) and carrying means 60 for carrying a medium 30 that has been carried onto the platen 20 forwardly on the platen 20. The printing head 14 has a structure for ejecting ink droplets by the piezo system or the like from nozzles 12 aligned on the lower surface thereof, and is supported travelably in the horizontal directions by a head drive belt 16. The carrying means 60 is constituted by a feed roller 62 and a press roller 64 provided so as to be opposed with the platen 20 therebetween above and below thereof. It has a structure in which the medium 30 is sandwiched between the feed roller 62 and the press roller 64 and the feed roller 62 is rotated forwardly (in a direction of an arrow in FIG. 1), and thereby, the medium 30 that has been carried onto the platen 20 can be carried forwardly on the platen 20.

Further, a preheater 40 for preliminarily heating the medium 30 to be forwardly carried toward below the traveling path of the printing head 14 on a rear part 24 of the platen and a print heater 70 for heating the medium 30 that has been carried onto the central part 22 of the platen 20 below the traveling path of the printing head 14, on which the inkjet droplets ejected from the nozzles 12 of the printing head are landed, are provided. The preheater 40 and the print heater 70 employ electric heaters using ceramics and nichrome wires. The preheater 40 has a structure disposed at the inner side of the rear part 24 of the platen for conducting the heat generated by the preheater 40 via the platen 20 to the medium 30 being carried on the rear part 24 of the platen so as to preliminarily heat the medium 30. The print heater 70 has a structure disposed at the inner side of the central part 22 of the platen for conducting the heat generated by the print heater 70 via the platen 20 to the medium 30 carried onto the central part 22 of the platen so as to heat the medium 30.

As ink to be supplied to the printing head 14 for ejecting ink droplets, solvent ink is used.

Further, heat control means 80 for controlling heating temperature of the preheater 40 and the print heater 70 for heating the medium 30 so that the surface temperature of the medium 30 to be carried onto the central part 22 of the platen 20, on which the inkjet droplets ejected from the nozzles 12 of the printing head are landed, may be 30 to 70° C. is provided. The heat control means 80 is constituted by a combination of a sensor for sensing heat generation temperature of the preheater 40 and the print heater 70 and an electronic circuit for controlling the heat generation temperature thereof or the like.

At the rear side of the platen 20, rewinding means 90 for rewindably supporting the medium 30 taken up in a roll form is provided.

At the front side of the platen 20, take-up means 100 for taking up the printed medium 30 to be fed out forwardly from a front part 26 of the platen in a roll form is provided.

The inkjet printer shown in FIG. 1 and FIG. 2 is formed as described above, and, when the inkjet printer is used, the medium 30 taken up in a roll form and supported by the rewinding means 90 at the rear side of the platen 20 is rewound, and the medium 30 is carried forwardly on the rear part 24 of the platen toward below the traveling path of the printing head 14 by the carrying means 60. At that time, the medium 30 being carried toward below the traveling path of the printing head 14 on the rear part 24 of the platen is heated by the preheater 40 to make it in a preliminarily heated state. The preheater 40 effectively acts in the case where the medium 30 carried onto the central part 22 of the platen can not be heated to sufficient and suitable temperature only by the print heater 70 because the medium 30 is thick or the ambient temperature at which the printer is placed is low, or the like. Further, subsequently, the medium 30 that has been preheated by the preheater 40, which is carried onto the central portion 22 of the platen below the traveling path of the printing head 14 from above the rear part 24 of the platen and carried onto the central portion 22 of the platen on which the ink droplets ejected from the nozzles 12 of the printing head are landed, is fully heated again by the print heater 70.

Then, by those preheater 40 and print heater 70, the medium 30 can be heated constantly in an appropriate manner without excess or deficiency so that the surface temperature of the medium 30 carried onto the central portion 22 of the platen, on which the ink droplets ejected from the nozzles 12 of the printing head are landed, may be desired temperature of 30 to 70° C.

Subsequently, on the surface of the medium 30 that has been heated in an appropriate manner so that the surface temperature thereof may be desired temperature of 30 to 70° C., ink droplets of solvent ink ejected from the nozzles 12 of the printing head to which the solvent ink is supplied are landed.

Then, the ink droplets of the solvent ink landed on the surface of the medium 30 can be dried promptly without permeating the medium 30 broadly in the surrounding parts of the landed points while keeping the state in which they are fixed in dots having small diameters in the landed parts on the surface of the medium 30 that has been heated in an appropriate manner at 30 to 70° C. Thus, pictorial diagrams and characters formed by arrangement of plural solvent ink dots and having water resistance and weather resistance with no smear can be printed on the surface of the medium 30 clearly.

As describe above, the medium 30 on the surface of which the pictorial diagrams and characters formed by arrangement of plural solvent ink dots has been printed is carried out from the central part 22 of the platen on the front part 26 of the platen by the carrying means 60. Then, the medium 30 is taken up in a roll form by the take-up means 100 at the front side of the platen 20.

In this inkjet printer, the temperature means 80 may have a structure that can independently control the heating temperature of the preheater 40 and the print heater 70, respectively. Further, each of the heating temperature of the medium 30 carried on the rear part 24 of the platen and heated by the preheater 40 and the heating temperature of the medium 30 carried onto the central part 22 of the platen and heated by the print heater 70 may be adjusted in an appropriate manner according to the kind of the medium 30, the thickness thereof, the ambient temperature at which the printer is placed, or the like. Furthermore, the surface part of the medium 30 carried onto the central part 22 of the platen, on which the inkjet droplets ejected from the nozzles 12 of the printing head are landed, may be heated constantly at desired temperature of 30 to 70° C. in an appropriate manner.

By the way, the temperature control means 80 may have a structure that can control the heating temperature of the preheater 40 and the print heater 70 integrally. Further, the structure of the temperature control means 80 may be simplified.

In the inkjet printer, as the solvent ink supplied to the printing head 14, ink having a major component of 40% by weight or more consisting of one of ethylene glycol monobutyl ether and propylene glycol monomethyl ether acetate or mixture of them may be used.

As described above, the influence of toxicity on the human body by the solvent ink may be suppressed, the odor of the solvent ink may be suppressed, and the handling risk of the solvent ink may be suppressed.

In addition, as described above, the major component of 40% by weight or more of the solvent ink may be one of ethylene glycol monobutyl ether and propylene glycol monomethyl ether acetate or mixture of them and thereby, pictorial diagrams and characters may be printed without smear but with high quality on the surface of the medium using the solvent ink while providing fixing stability.

The composition of the solvent ink supplied to the printing head 14 other than the major component includes, for example, an organic pigment of 3% to 7% by weight and a resin of 15% by weight or less, and a solvent of one or more kinds of ethylene glycol monomethyl ether, ethylene glycol monomethyl ether acetate, diethylene glycol monomethyl ether, diethylene glycol monomethyl ether acetate, diethylene glycol monoethyl ether, diethylene glycol, propylene glycol monoethyl ether acetate, propylene glycol, cyclohexanon, etc.

As the organic pigment, for example, Pigment Red 88, 181, 122, 202, 207, 209, Pigment Blue 15, 15:1, 15:2, 16, 68, Pigment Yellow 108, 196, 138, 128, 129, 180, 181, or Carbon Black is used. One or more of those organic pigments are added to the solvent ink according to the color to be printed using the solvent ink.

As the resin added to the solvent ink, silicon-contain resin, vinyl resin, ester resin, or fluorine-contain resin is used.

Next, using the solvent ink having such composition, by the inkjet printer provided with the above described preheater 40 and print heater 70, experimental examples in the case where pictorial diagrams and characters are printed on various kinds of media 30. In any experimental example, the inkjet printer is placed within a room in a normal temperature condition of the room temperature at about 15 to 20° C. In the following tables, the medium heating temperature of the preheater indicates heating temperature on the surface of the medium 30 carried on the rear part 24 of the platen by the preheater 40, the medium heating temperature of the print heater indicates heating temperature on the surface of the medium 30 carried onto the central part 22 of the platen, on which the inkjet droplets ejected from the printing head 14 are landed, by the print heater 70. Image quality (definition, with or without smear, etc.) in each of the following tables is on a zero-to-ten scale, and the highest point is ten. "OFF" in each of the following tables indicates the state in which the preheater 40 and the print heater 70 are not energized and the heating of the medium 30 by the preheater 40 or the print heater 70 is being stopped.

EXPERIMENTAL EXAMPLE 1

As the medium, MacMarc: 9829-00 (a product name of a medium manufacturer) is used.

| | | | | | | |
|---|---|---|---|---|---|---|
| Media heating temperature of preheater | OFF | 35° C. | 40° C. | 45° C. | 45° C. | OFF |
| Media heating temperature of print heater | OFF | 35° C. | 40° C. | 45° C. | OFF | 45° C. |
| Image quality | 4 | 6 | 6 | 6 | 6 | 6 |

EXPERIMENTAL EXAMPLE 2

As the medium, Transparent PVC Film P-245RC: LINTEC (a product name of a medium manufacturer) is used.

| | | | | | | |
|---|---|---|---|---|---|---|
| Media heating temperature of preheater | OFF | 35° C. | 40° C. | 45° C. | 45° C. | OFF |
| Media heating temperature of print heater | OFF | 35° C. | 40° C. | 45° C. | OFF | 45° C. |
| Image quality | 4 | 7 | 7 | 8 | 6 | 7 |

EXPERIMENTAL EXAMPLE 3

As the medium, PVC Viewcal 880C: LINTEC (a product name of a medium manufacturer) is used.

| | | | | | | |
|---|---|---|---|---|---|---|
| Media heating temperature of preheater | OFF | 35° C. | 40° C. | 45° C. | 45° C. | OFF |
| Media heating temperature of print heater | OFF | 35° C. | 40° C. | 45° C. | OFF | 45° C. |
| Image quality | 2 | 5 | 5 | 6 | 3 | 6 |

EXPERIMENTAL EXAMPLE 4

As the medium, Tarpaulin SJT-V200F: HIRAOKA (a product name of a medium manufacturer) is used.

| | | | | | | |
|---|---|---|---|---|---|---|
| Media heating temperature of preheater | OFF | 35° C. | 40° C. | 45° C. | 45° C. | OFF |
| Media heating temperature of print heater | OFF | 35° C. | 40° C. | 45° C. | OFF | 45° C. |
| Image quality | 7 | 8 | 8 | 8 | 7 | 8 |

EXPERIMENTAL EXAMPLE 5

As the medium, MPI2010WHITE/PERM/90: Avery (a product name of a medium manufacturer) is used.

| | | | | | | |
|---|---|---|---|---|---|---|
| Media heating temperature of preheater | OFF | 35° C. | 40° C. | 45° C. | 45° C. | OFF |
| Media heating temperature of print heater | OFF | 35° C. | 40° C. | 45° C. | OFF | 45° C. |
| Image quality | 5 | 8 | 9 | 9 | 8 | 9 |

EXPERIMENTAL EXAMPLE 6

As the medium, MPI3000/PERM/90: Avery (a product name of a medium manufacturer) is used.

| | | | | | | |
|---|---|---|---|---|---|---|
| Media heating temperature of preheater | OFF | 35° C. | 40° C. | 45° C. | 45° C. | OFF |
| Media heating temperature of print heater | OFF | 35° C. | 40° C. | 45° C. | OFF | 45° C. |
| Image quality | 7 | 8 | 9 | 10 | 9 | 10 |

EXPERIMENTAL EXAMPLE 7

As the medium, PVC Film P-243RW: LINTEC (a product name of a medium manufacturer) is used.

| | | | | | | |
|---|---|---|---|---|---|---|
| Media heating temperature of preheater | OFF | 35° C. | 40° C. | 45° C. | 45° C. | OFF |
| Media heating temperature of print heater | OFF | 35° C. | 40° C. | 45° C. | OFF | 45° C. |
| Image quality | 7 | 8 | 8 | 8 | 7 | 7 |

EXPERIMENTAL EXAMPLE 8

As the medium, TACKPAINT: SEKISUI CHEMICAL (a product name of a medium manufacturer) is used.

| | | | | | | |
|---|---|---|---|---|---|---|
| Media heating temperature of preheater | OFF | 35° C. | 40° C. | 45° C. | 45° C. | OFF |
| Media heating temperature of print heater | OFF | 35° C. | 40° C. | 45° C. | OFF | 45° C. |
| Image quality | 7 | 7 | 8 | 8 | 8 | 8 |

According to the respective tables shown in these experimental examples 1 to 8, it is known that the image quality of the pictorial diagrams and characters printed on the surface of the medium 30 is improved by preliminarily heating the medium 30 by the print heater 70 for printing the pictorial diagrams and characters with the preheater 40, and heating the medium 30 on which inkjet droplets ejected from the printing head 14 are landed.

In this inkjet printer, the control of heating temperature of the preheater 40 and the print heater 70 for heating the medium 30 by the heat control means 80 may be changed or adjusted by an additional operation panel (not shown) to a printer or a host computer 120 for printer control to which a printer is connected. Further, the heating temperature of the medium 30 by the preheater 40 and the print heater 70 controlled by the heat control means 80 may be changed or adjusted by an additional operation panel (not shown) to a printer or a host computer 120 for printer control to which a printer is connected according to the kind and thickness of the medium 30 carried on the platen 20, the ambient temperature at which the printer is placed, or the like. Furthermore, various kinds of media 30 such that softened at low temperature in various thicknesses may be constantly carried on the platen 20 smoothly by the carrying means 60.

In the inkjet printer, as shown in FIG. 2, refresh mode means 140 for moving the printing head 14 to a maintenance station 130 at the side part of the platen 20 and trial-discharging (flushing) ink droplets from the nozzles 12 of the printing head so as to prevent the solvent ink from being solidified and causing clogging within the nozzles 12 of the printing head may be provided. The refresh mode means 140 may be constituted by an electronic circuit of the host computer 120 for printer control etc. Further, in the process of printing pictorial diagrams and characters on the surface of the medium 30 using the solvent ink, using the refresh mode means 140, the printing head 14 may be moved to the maintenance station 130 and ink droplets may be trial-discharged from the nozzles 12 of the printing head into a receiving tray 110 provided in the maintenance station 130 or the like. Accordingly, the solvent ink may be prevented from being solidified within the nozzles 12 of the printing head and causing clogging of the nozzles 12. Further, missing dots may be prevented from occurring in parts of pictorial diagrams and characters on the surface of the medium 30 printed using the clogged printing head 14.

Furthermore, in that case, the refresh mode means 140 may adopt a structure for moving the printing head 14 to the maintenance station 130 and trial-discharging ink droplets from the nozzles 12 of the printing head at regular time intervals. Then, at regular time intervals in the process of printing pictorial diagrams and characters on the surface of the medium 30 using the solvent ink, using the refresh mode means 140, the printing head 14 may be moved to the maintenance station 130 and ink droplets may be forced to be trial-discharged from the nozzles 12 of the printing head. Accordingly, the solvent ink may be ensured to be prevented from being solidified within the nozzles 12 of the printing head and causing clogging of the nozzle 12 because of the failure to move the printing head 14 to the maintenance station 130 and trial-discharging ink droplets from the nozzles 12 of the printing head in the process of printing pictorial diagrams and characters on the surface of the medium 30 using the solvent ink.

Figure 3:
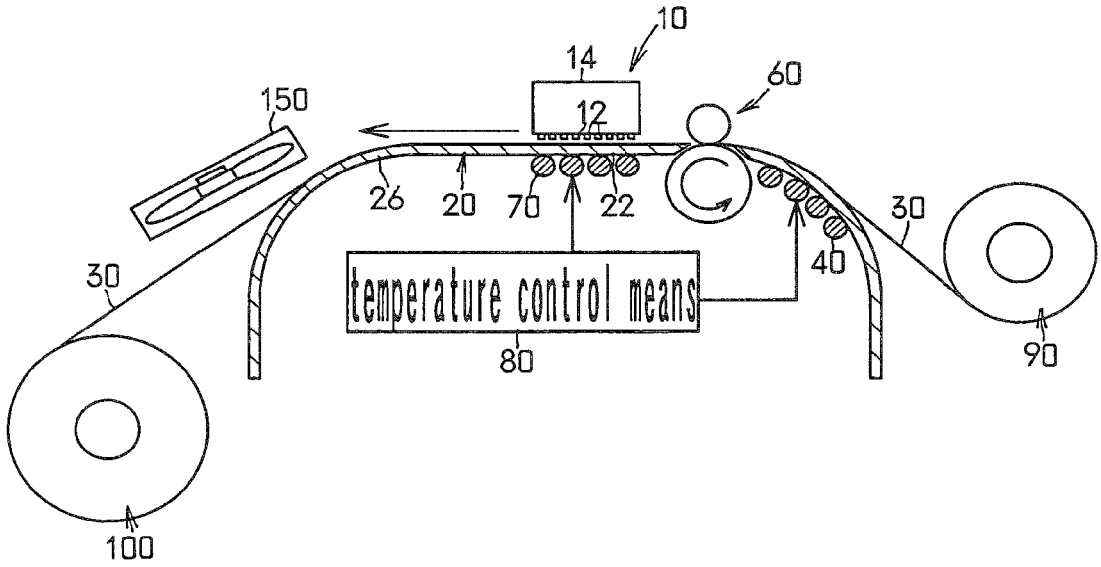
FIG. 3 is a side sectional view showing the schematic structure of another inkjet printer of the invention.
Figure 4:
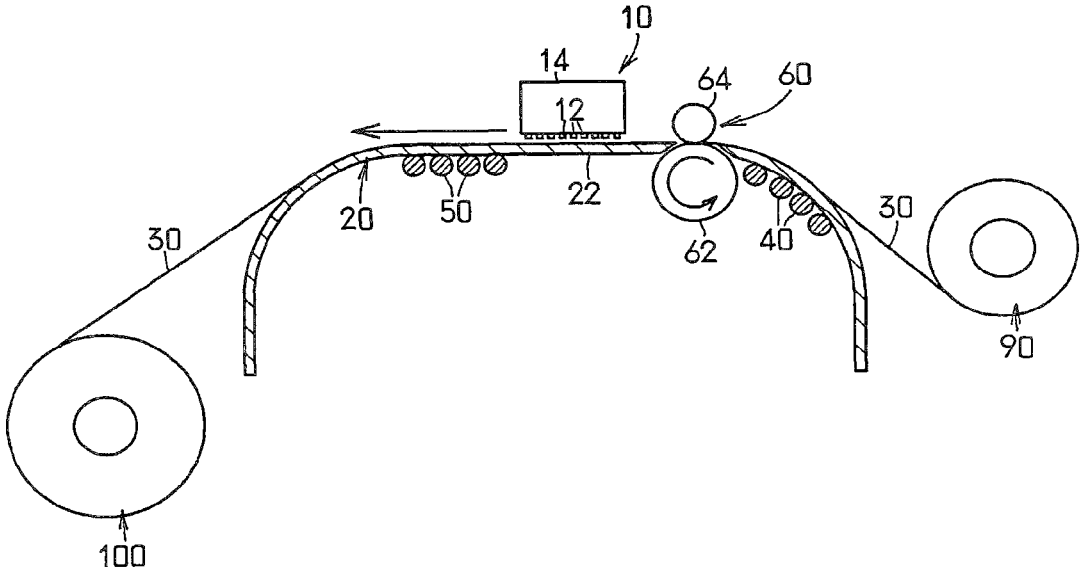
FIG. 4 is a side sectional view showing the schematic structure of a conventional inkjet printer of the invention.

In the inkjet printer, as shown in FIG. 3, drying means 150 for drying the ink droplets adhering to the landed points of the surface of the medium 30 carried out onto the front part 26 of the platen from below the traveling path of the printing head 14 may be provided. The drying means 150 may employ a blow drier, an infrared drier, and a heater drier using ceramics, nichrome wires, or the like singly or in combination. Further, the droplets adhering to the landed points of the surface of the medium 30 carried out onto the front part 26 of the platen from below the traveling path of the printing head 14 in partly undried conditions may be dried completely by the drying means 150. Further, the droplets adhering to the landed points of the surface of the medium 30 in partly undried conditions, which is taken up in a roll form or the like by the forward take-up means 100 from the front part 26 of the platen may be prevented from adhering to other parts of the medium 30 taken up in a roll form or the like and contaminating the medium 30 with the ink.

INDUSTRIAL APPLICABILITY

As described above, the inkjet printer of the invention is suitable for printing pictorial diagrams and characters on the surface of the medium for outdoor display advertisement or the like that requires water resistance and weather resistance with high image quality and fixing stability. Similarly, the inkjet printer is suitable for printing pictorial diagrams and characters on the surface of the medium for various industries that require water resistance.

What is claimed is:

1. An inkjet printer to eject solvent ink, comprising:

a platen;

a printing head configured to move in a right-left direction above the platen and eject solvent ink from nozzles of the printing head on a medium at a printing position substantially in alignment with the printing head which does not have a heater for the printing head, the medium made of a polyvinyl chloride film on which no coating agent is applied, the solvent ink comprising an organic pigment of from 3 to 7 weight %, a resin of 15 weight % or less, and solvents;

a feeding device configured to feed the medium on the platen in a forward direction substantially perpendicular to the right-left direction;

a pre-heater configured to preliminarily heat the medium on the platen before the printing position in the forward direction;

a print heater configured to heat the medium at the printing position, the print heater being arranged separately from the pre-heater;

a temperature controller configured to control a pre-heater heating temperature of the pre-heater and a print heater heating temperature of the print heater such that a surface temperature of the medium at the printing position becomes within a range of from 30° C. to 70° C.; and a refresh mode device configured to move the printing head to a maintenance station to eject ink droplets from the nozzles of the printing head so as to mitigate clogging in the nozzles at predetermined time intervals.

2. The inkjet printer according to claim 1, wherein the temperature controller is capable of controlling the pre-heater heating temperature of the pre-heater and the print heater heating temperature of the print heater independently.

3. The inkjet printer according to claim 1, wherein the temperature controller is configured to control the pre-heater heating temperature of the pre-heater and the print heater heating temperature of the print heater to be substantially same.

4. The inkjet printer according to claim 1, further comprising:

a dryer configured to dry the ink droplets deposited on a surface of the medium which is fed to a front part of the platen from below the printing head.

5. The inkjet printer according to claim 4, wherein the dryer is an infrared drier.

6. The inkjet printer according to claim 4, wherein the dryer is a heater drier using ceramics, and/or nichrome wires.

7. The inkjet printer according to claim 4, wherein the dryer is a blow drier configured to blow air directly onto the surface of the medium.

8. The inkjet printer according to claim 1, wherein the solvent ink includes a main component occupying 40 weight % or more of the solvent ink that is at least one of ethylene glycol monobutyl ether and propylene glycol monomethyl ether.

9. The inkjet printer according to claim 1, further comprising:

a first roller is provided upstream of the printing head in order to feed the medium in a roll form to the printing head; and a second roller is provided downstream of the printing head in order to take up the medium in a roll form on the second roller after printing.

10. The inkjet printer according to claim 9, wherein the first roller is further configured to rewind in order to take up the medium in a roll form on the first roller.

11. The inkjet printer according to claim 1, further comprising:

a dryer configured to dry the ink droplets deposited on a surface of the medium, said dryer being provided at a location downstream of the printing head in the forward direction.

12. The inkjet printer according to claim 11, wherein the dryer is an infrared drier.

13. The inkjet printer according to claim 11, wherein the dryer is a heater drier using ceramics, and/or nichrome wires.

14. The inkjet printer according to claim 11, wherein the dryer is a blow drier configured to blow air directly onto the surface of the medium.

15. An inkjet printer to eject solvent ink, comprising:

a platen;

a printing head configured to move in a right-left direction above the platen and eject solvent ink from nozzles of the printing head on a medium at a printing position substantially in alignment with the printing head, the medium made of a polyvinyl chloride film on which no coating agent is applied, the solvent ink comprising an organic pigment of from 3 to 7 weight %, a resin of 15 weight % or less, and solvents;

a feeding device configured to feed the medium on the platen in a forward direction substantially perpendicular to the right-left direction;

a print heater configured to heat the medium at the printing position; and a temperature controller configured to control a print heater heating temperature of the print heater such that a surface temperature of the medium at the printing position becomes within a range of from 30° C. to 70° C.

* * * * *